US005441092A

United States Patent [19]

Randle

[11] Patent Number: 5,441,092

[45] Date of Patent: Aug. 15, 1995

[54] METHOD AND APPARATUS FOR THE PRODUCTION OF HEART CENTERED, SUBSTANTIALLY SQUARE TIMBERS

[76] Inventor: Hale Randle, 4031 Rundlehorn Drive N.E., Calgary, Alberta, Canada, T1Y 2K2

[21] Appl. No.: 86,112

[22] Filed: Jul. 6, 1993

[51] Int. Cl.[6] ..... B27B 1/00; B27B 7/00; B27B 31/00

[52] U.S. Cl. ..... 144/378; 83/155; 83/409; 83/422; 83/425.2; 83/708; 144/242 R; 144/242 E; 144/242 M

[58] Field of Search ..... 83/102, 155, 471.1, 83/471.2, 425, 425.4, 422, 157, 708, 717, 719; 144/1 R, 242 R, 242 D, 242 E, 242 H, 242 M, 376, 377, 378

[56] References Cited

U.S. PATENT DOCUMENTS

| | | | |
|---|---|---|---|
| 3,903,771 | 9/1975 | Fritz et al. | 144/378 |
| 4,147,256 | 4/1979 | Nilsson | 144/376 |
| 4,262,572 | 4/1981 | Flodin | 83/471.2 |
| 4,341,248 | 7/1982 | Critchell | 144/378 |
| 4,419,914 | 2/1983 | Evans | 144/378 |
| 4,697,487 | 10/1987 | Cameron | 144/378 |
| 4,823,664 | 4/1989 | Cooper, Jr. et al. | 144/376 |
| 4,846,237 | 7/1989 | Wolf | 144/3 R |
| 5,035,166 | 7/1991 | Carlson et al. | 144/378 |

*Primary Examiner*—W. Donald Bray

[57] ABSTRACT

A method and apparatus for the efficient production of heart wood centered small dimensioned, square timber comprising a log feed system for the storage and dispensing of individual logs to the production facility; a log centering system wherein the log is centrally aligned with multiple saw blades and clamped into position; a log transport system comprising a movable carriage which transports the clamped log through the blades; and a separation system wherein the finished timber is separated from the side cuts and positioned ready for easy stacking. The log is first cut longitudinally and perpendicularly along two sides. A rotating means located within the centering system turns the log onto one of its two sawn sides and the log is again passed through the blades and cut longitudinally and perpendicularly, thus forming a timber with a square cross section and the heart wood centered therein.

7 Claims, 9 Drawing Sheets

METHOD AND APPARATUS FOR THE PRODUCTION OF HEART CENTERED, SUBSTANTIALLY SQUARE TIMBERS

BACKGROUND—FIELD OF INVENTION

This invention relates to sawmills, more specifically the production of small dimensioned square timber (to as small as 4"×4") wherein the heart wood is maintained central to the finished timber.

BACKGROUND—DESCRIPTION OF PRIOR ART

Softwood lumber production has been and continues to be, a significant contributor to both the Canadian and United States economies with Canada ranking third in the world for overall softwood lumber production with an annual output of approximately 61,000,000 cubic meters.

Not surprisingly, then, the number of sawmills in operation in both countries is very large—approximately 3,500 large mills plus many thousands of smaller mills in the United States alone—and the configuration of such mills can vary widely.

A typical softwood log sawmill has the saws installed on an upper deck, with ancillary equipment at ground level. A sloping conveyor ("a Jack Ladder") brings up a continuous supply of logs from a log pond or storage yard to the saw deck.

General practice in Northern Europe is to use frame saws consisting of a vertically reciprocating frame in which a number of saw blades are mounted, wherein the blades can be spaced as required depending upon the thickness of timber to be produced.

Many of the mills located in Eastern Canada and the United States use circular saws but larger mills are generally equiped with bandsaws. Because of the great size of many of the logs available along the Pacific coast, common practice in Western Canada and the United States is to use large bandsaws.

Normal sawing procedure is to first saw the raw log to provide a center block and side boards. The side boards fall upon rollers which carry them to either a stacking area or edging saws for further processing, while the centre block is turned on one of its two sawn sides and fed through a second frame saw which converts it into square edged timber.

Since the heart center or area of the pith of any given log is most likely to contain defects and is also subject to "heart shakes" it is generally excluded from the higher wood grades. A commonly used, economical method of sawing logs to exclude the heart center is known as Wainscot Cutting. In this method the square edged timber is sawn through the heart into two halves and one or two boards taken off each side of the cut to eliminate any defects which may be present.

It will be readily understood that the most efficient way to implement the Wainscot Cut to yield a maximization of wood volume is to first ensure that the heart center of the timber is indeed, centered.

Present sawmills make few (and in some cases none) provisions to enable accurate and efficient centering of the raw log prior to the initial cutting, thus the resultant square edged timber may or may not emerge with the heart wood centered leading to excessive waste during the remanufacturing of specific sized lumber.

OBJECTS AND ADVANTAGES

Accordingly, besides the objects and advantages of the sawmills described above, several objects and advantages of the present invention are:

(a) to provide a sawmill capable of accurately maintaining the heart wood centered in the production of square edged timber;

(b) to provide a sawmill which eliminates the need for a second blade set during the production of square edged timber;

(c) to provide a sawmill which is capable of producing relatively small dimensioned square edged timbers;

(d) to provide a sawmill which is portable;

(e) to provide a sawmill requiring a minimum of operating personnel;

(f) to provide a sawmill which is relatively low cost with respect to manufacturing; and (g) to provide a sawmill which is highly automated and efficient.

Further objects and advantages of the present invention are to provide a sawmill which, by nature of its automated procedures, offers a higher degree of safety than that of the prior art.

Still further objects and advantages will become apparent from a consideration of the ensuing description and drawings.

DRAWING FIGURES

The present invention, as exemplified by a preferred embodiment, is herein fully described having reference to the following drawings wherein:

FIG. 1; is a block diagram showing the various steps performed in the production of heart centered square edged timber;

FIG. 2; is a perspective, partial view of the raw log feed system components;

FIG. 3; is a perspective view of the sawmill showing a log centered and ready for a first pass cut;

FIG. 4; is a perspective view of the sawmill illustrating a log undergoing a first pass cut;

FIG. 5; is a close up perspective view of various of the centering system components;

FIG. 6; is a perspective view of the side board sorting and stacking system components;

FIG. 7; is a perspective view of the side board sorting and stacking system components with boards stacked;

FIG. 8; is a perspective view of the finished timber bucking system components with a finished timber in transit to its stacking area; and FIG. 9; is a view of a prior art log transport system used in the present invention and provided for purposes of clarity.

DESCRIPTION OF THE PREFERRED EMBODIMENT

Figure 1:
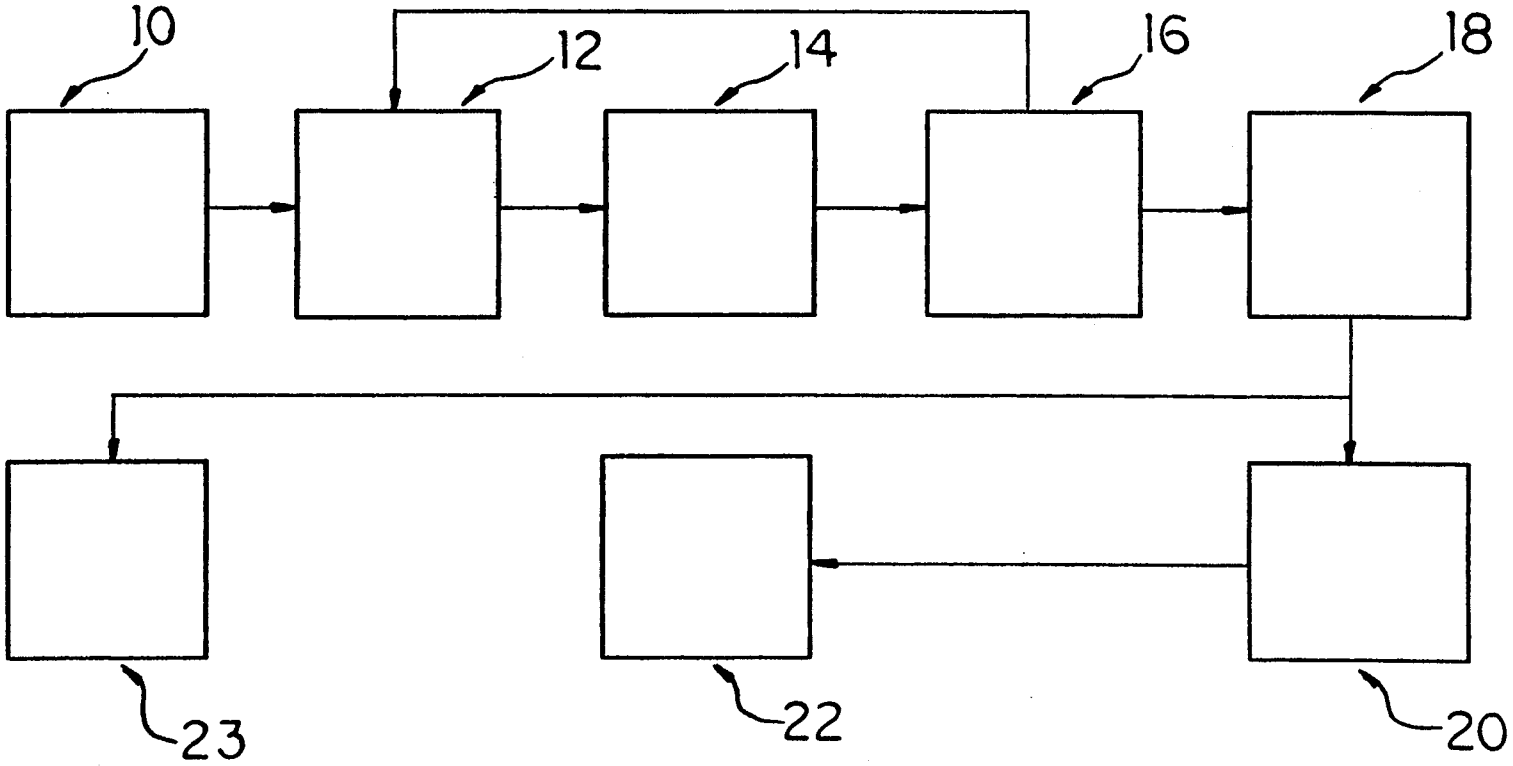
Figure 2:
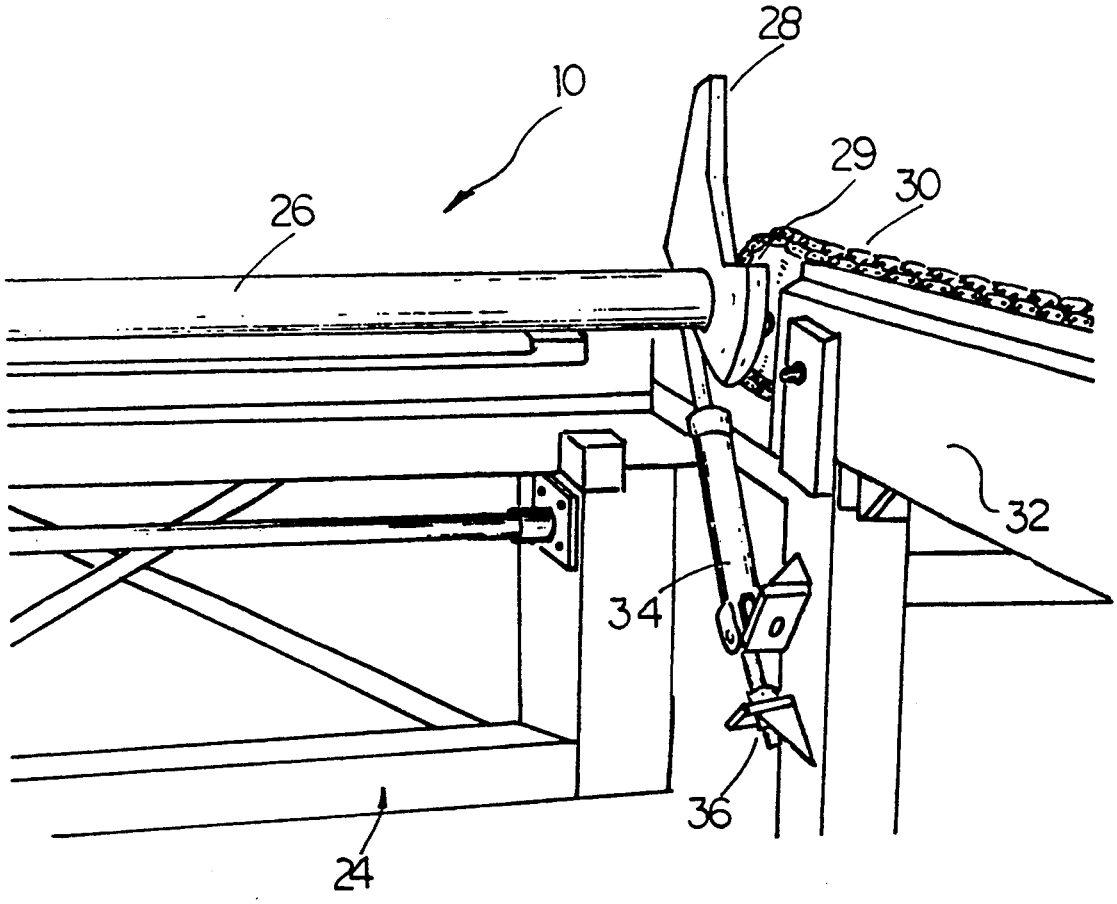
Figure 3:
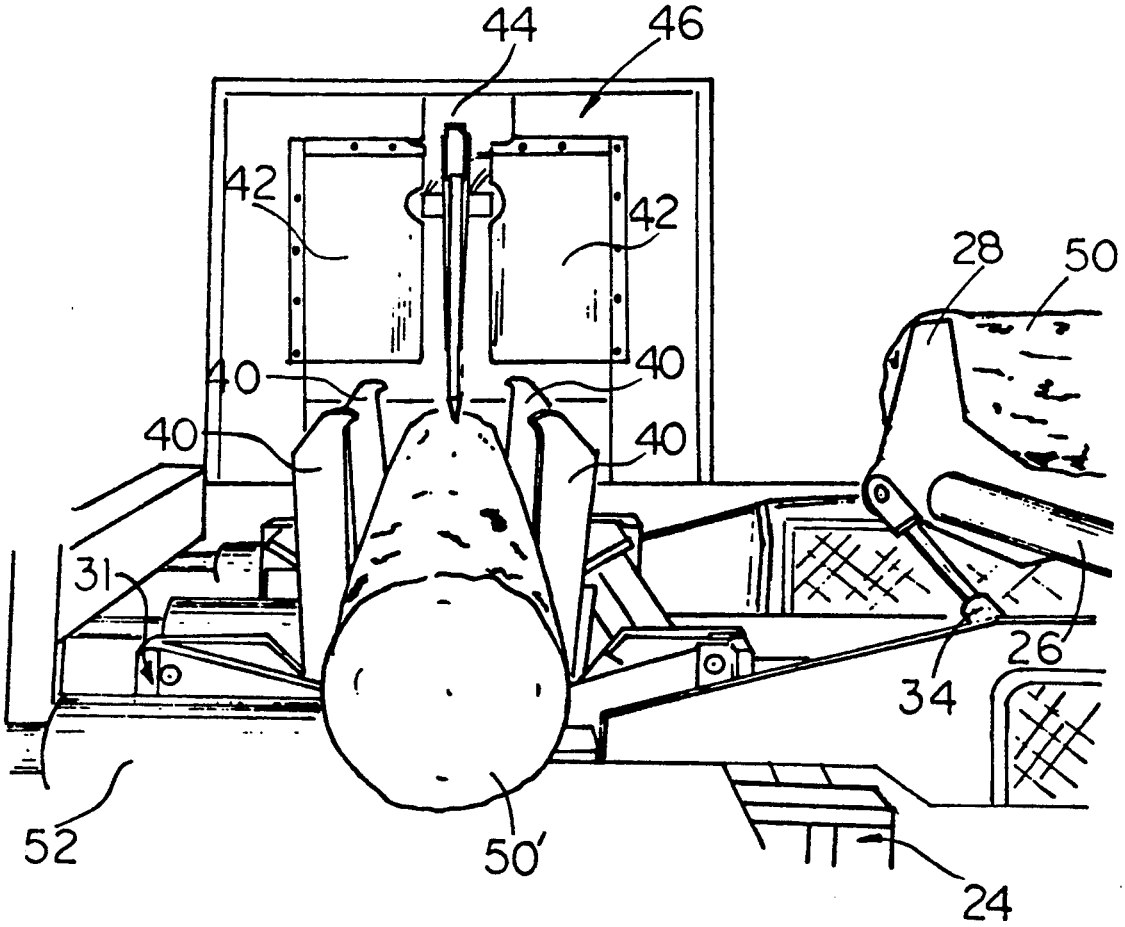
Figure 4:
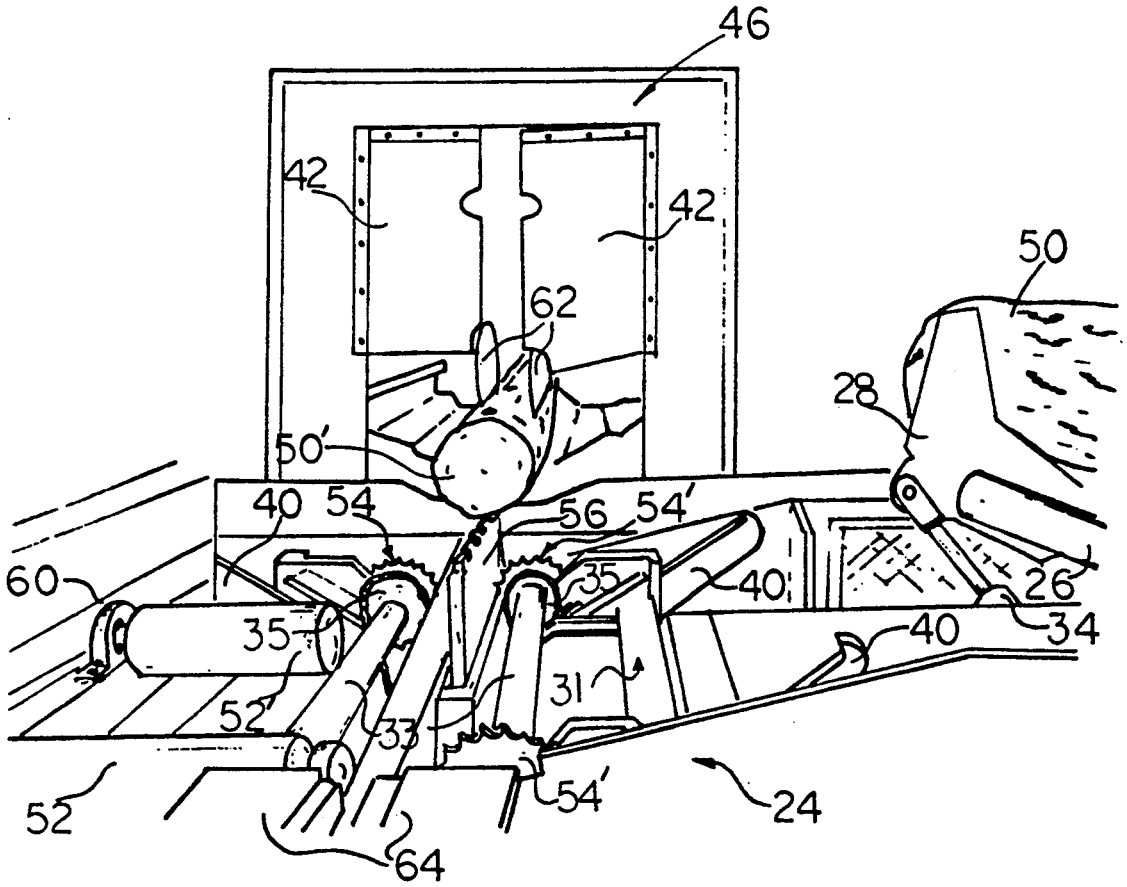
Figure 5:
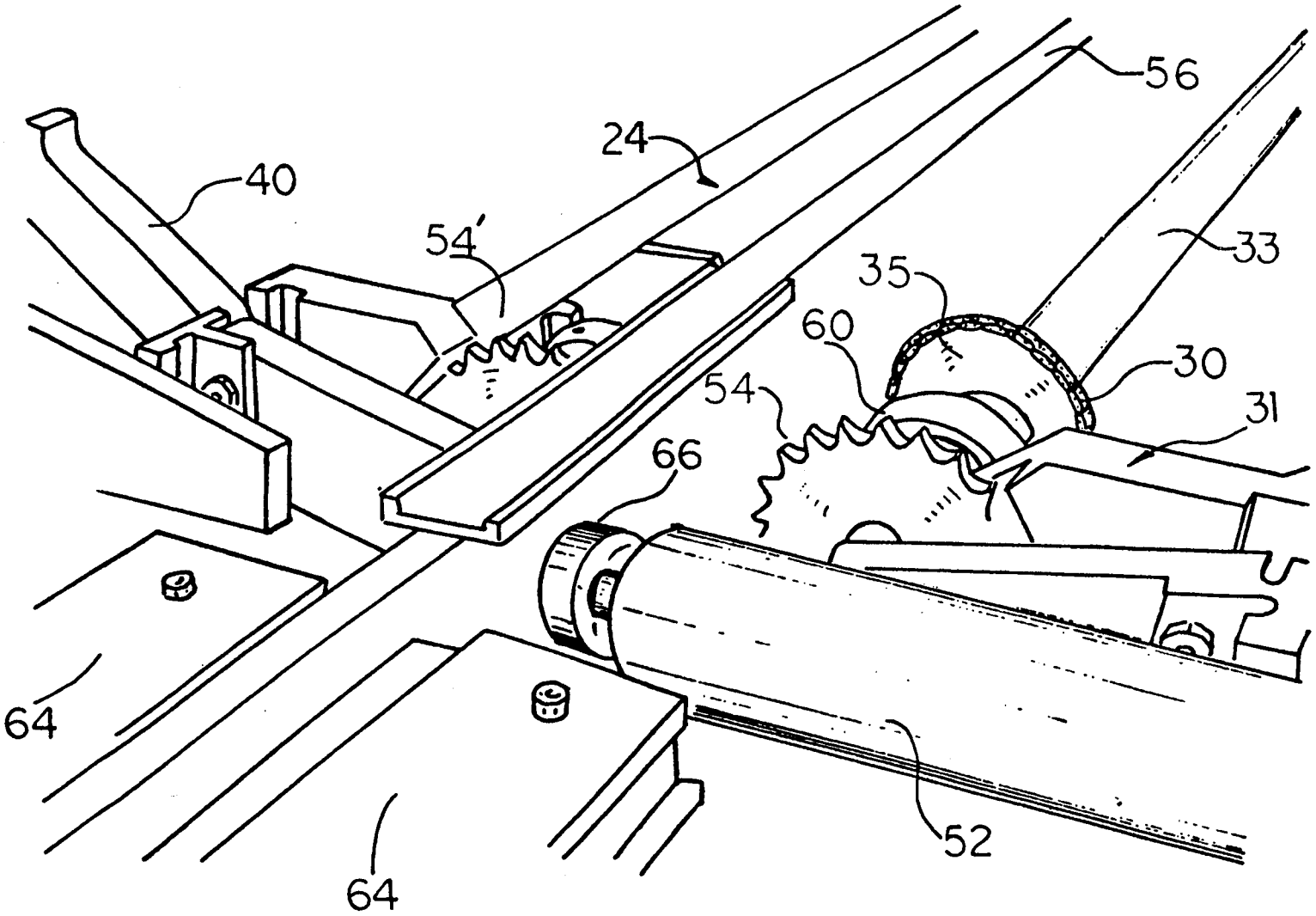
Figure 6:
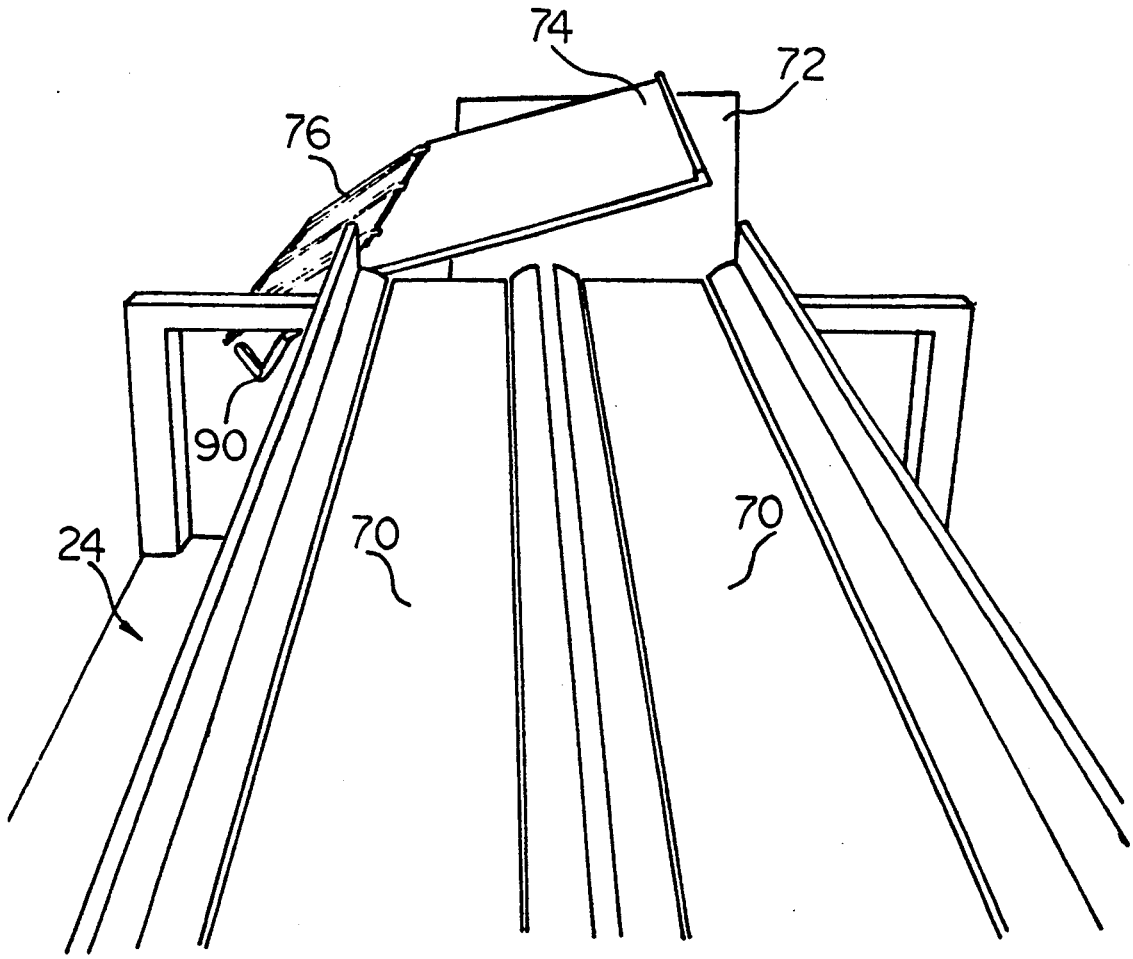
Figure 7:
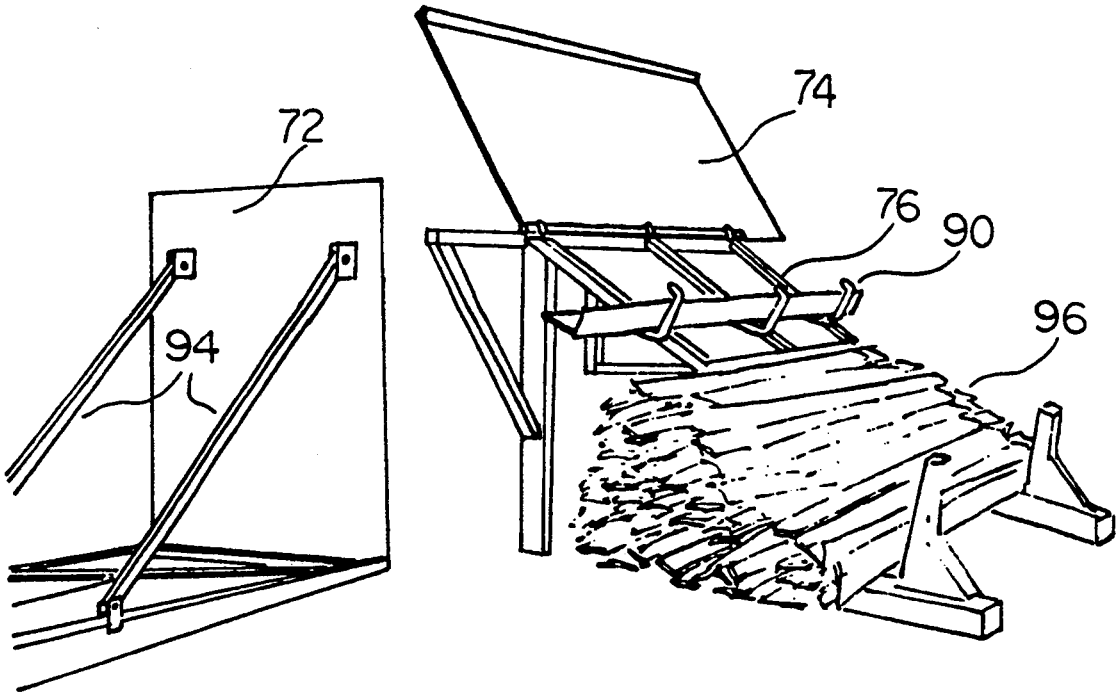
Figure 8:
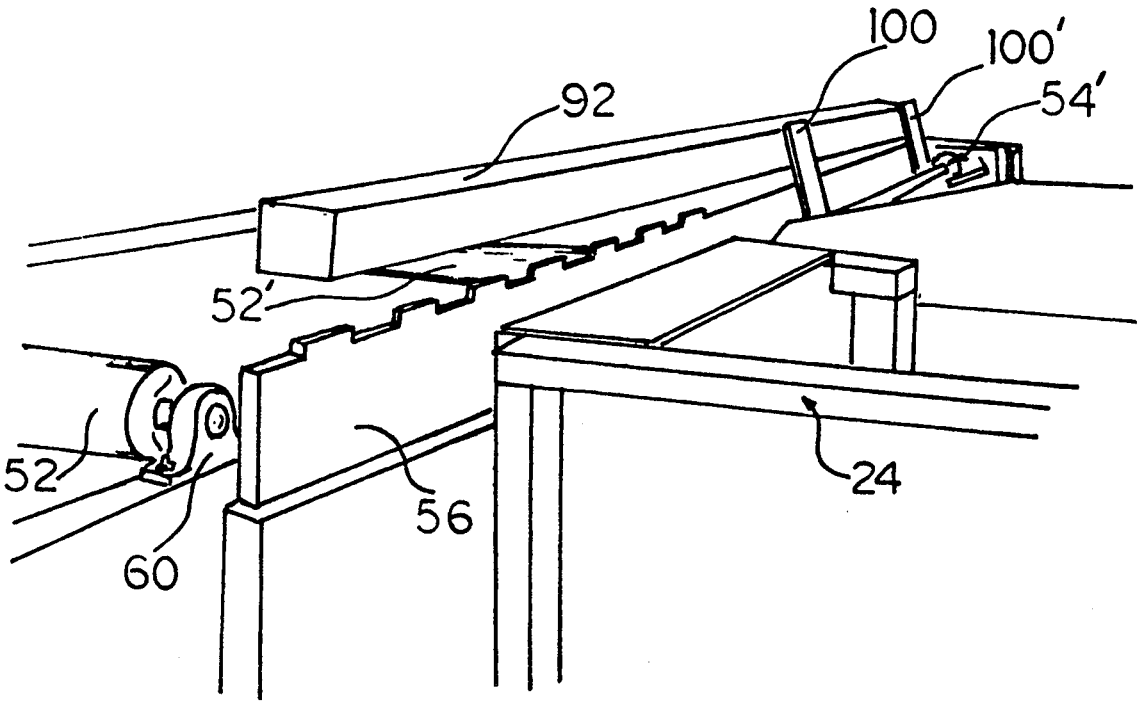

Referring to FIG. 1, it may be seen that the production method of the present invention is comprised of a number of discrete steps carried out by means of a variety of integrated and mutually cooperating systems comprised of a raw log feed system 10 wherein the raw logs are stacked on a controllable conveyor and presented to a log transport system 14 and a log centering system 12, one at a time.

Upon arrival at the log transport system 14, an individual log is centered on said transport 14 by means of hydraulically actuated components of the log centering system 12. The log is clamped to the transport system 14 by hydraulically actuated components of said transport 14, the centering system 12 is withdrawn, and the log is transported through the log cutting system 16 wherein longitudinal, perpendicular side cuts are made to the log in a repetitive manner (if necessary) such as to provide dual perpendicular surfaces free from log bark.

The log is withdrawn from the cutting system 16 back to the log's original entry position from the feed system 10 by movement of the transport system 14; the centering system 12 is re-engaged, the clamping means of the transport system 16 released and rotating components of the centering system 12 raised to turn the log onto one of its two sawn sides.

The log is again centered upon the transport 14 and clamped in place upon said transport 14 by hydraulically actuated clamping means. The centering system 12 is withdrawn and the log is again transported through the cutting system 16 wherein longitudinal, perpendicular side cuts are made to the log in a repetitive manner (if necessary) such as to provide dual perpendicular surfaces free from log bark and the resultant cut timber is of a substantially square cross section, the heart wood of which is substantially centered therein.

The log is once more withdrawn from the cutting system 16 back to the log's original entry position from the feed system 10 by movement of the transport system 14; the centering system 12 is re-engaged, the clamping means of the transport system 16 released and hydraulically actuated bucking means of the centering system 12 are activated to eject the finished timber from the transport system 14 in a direction opposite that of the log's entry from the feed system 10.

The thus ejected square timber is conveyed via a series of rotating rollers to a finished timber stacking area 23 while the scrap and side boards generated during the cutting process are conveyed to a separation system 18and onward to a side board stacking area 20 and a scrap stacking area 22. The raw! log feed system 10 is activated releasing another log to the transport 14 and centering 12 systems and the process repeated.

Referring now to FIGS. 2 to 9, it may be seen that the raw log feed system 10 is comprised of a horizontally disposed rigid bar 26 of uniform, circular cross section having permanently affixed to each end thereof a crank webb 28 consisting of robust, rigid material of uniform thickness.

Dual, continuous loop chains 30 are horizontally disposed at right angles to each of the crank webbs 28 and supported by a chain sprocket 29 permanently affixed to the outer surface of each of the crank webbs 28 and driven at each of the opposite ends by any conventional means. Each chain 30run is substantially enclosed in a chain shroud 32 consisting of a three walled rectilinear structure of rigid material and of uniform wall thickness.

A generally reticulated support structure 24 is comprised of a plurality of substantially rectangular box members of uniform wall thickness and forms an integral part of a support frame for the overall sawmill structure.

A hydraulic cylinder 34 of conventional design is detachably affixed at the actuator end to an outside edge of one of the crank webbs 28 and detachably and adjustably 36 affixed at the other end to rigid brackets permanently affixed to the outer wall surface of a structural frame member 24. The control means for the activation of the hydraulic cylinder 34 is of a conventional type and well understood by those skilled in the art.

The log centering system 12 is comprised of four pivotably movable centering fingers 40 of robust, rigid material of uniform thickness, each of which is generally rectangular in shape with a curved hook-like protuberance at one end and each interconnected at the opposite end such that all four fingers 40 act together as one.

The log centering system 12 further includes dual horizontally disposed shafts 33 of uniform, circular cross section and each terminated at either end by chain sprockets 54 and 54' and supported by conventional bearing support blocks 60. Mounted and locked on each shaft 33 and located in from one end of each shaft 33, forward of the bearing support block 60 is a chain sprocket 35 of a diameter smaller than that of each of the chain sprockets 54 and 54' and upon which is set a continuous loop chain 30 each driven by any conventional means such that rotation of each of the shafts 33 is in the same direction.

The log centering system 12 further includes dual bucking fingers 100 and 100' consisting of rigid material of uniform wall thickness and generally rectangular in shape each interconnected at one end such that movement is simultaneous. The bucking fingers 100 and 100' are controlled by conventional hydraulic means, well understood by those skilled in the art, such as to provide a reciprocating motion in the vertical plane.

The log centering system 12 further includes a support structure 31 of rigid material and equipped with various mounting means wherein is contained said centering fingers 40, said shafts 33, sprockets 54 and 54', bearing blocks 60, chain sprockets 35, chain loops 30 and bucking fingers 100 and 100', together with their respective drives and hydraulic actuators, not shown but well understood by those skilled in the art.

The log centering system 12 is slidably movable in a vertical plane within the confines of the sawmill frame structure 24 by means of hydraulic actuators (not shown but well understood by those skilled in the art) detachably and adjustably affixed to both the centering system 12 support structure 31 and the sawmill frame 24.

Figure 9:
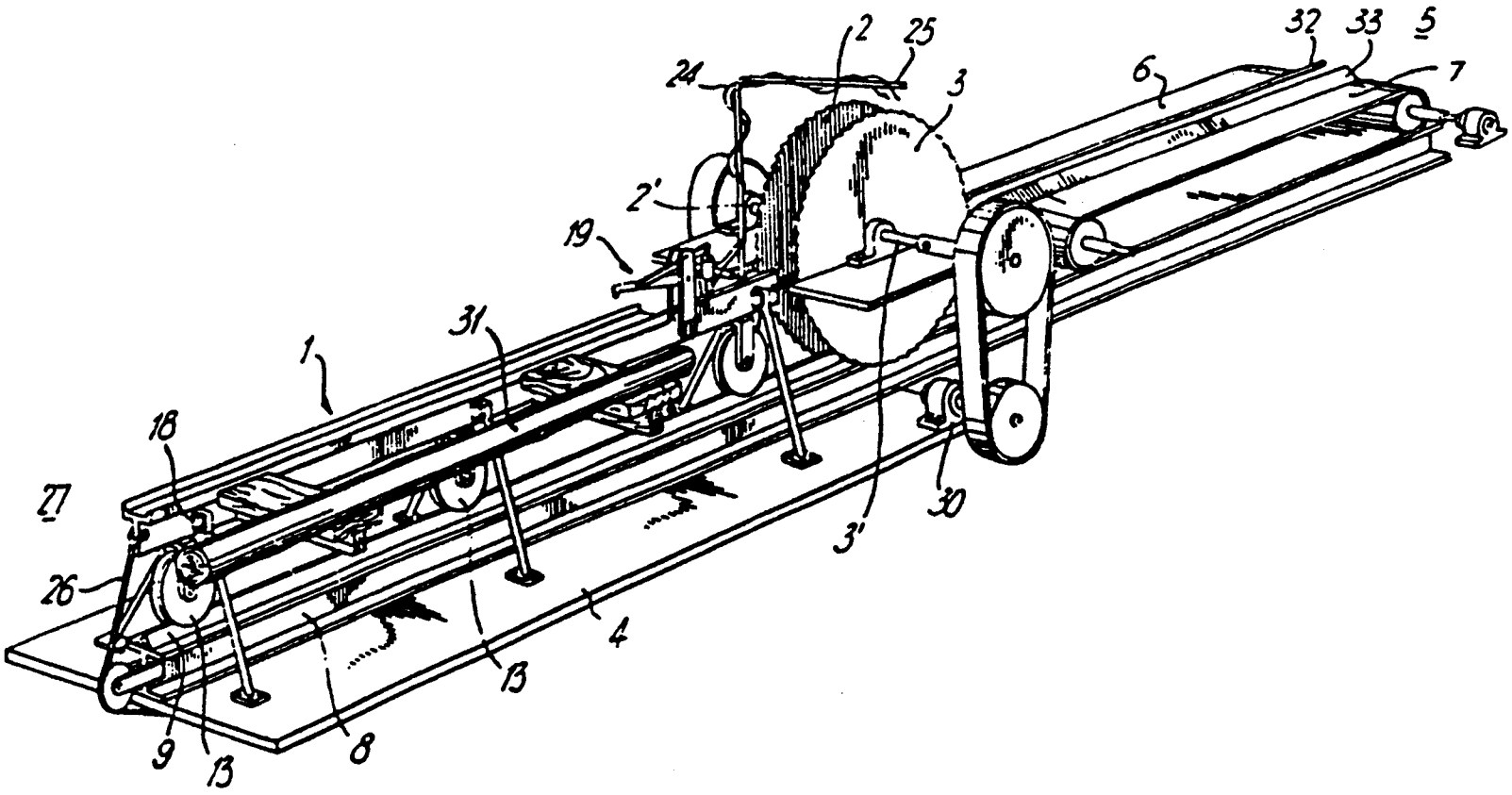

The log transport 14 and log cutting 16 systems are substantially comprised of the invention disclosed in U.S. Pat. No. 4,177,704 to Randle, 1979, a drawing of which is reproduced for clarity as FIG. 9 herein and which is essentially comprised of a plurality of circular blades 62 (FIG. 9. 2 and 3) the spacing of which is continuously adjustable and between which a horizontally disposed carriage 56 (FIG. 9. 1) bearing a log is drawn back and forth by a system of belts and pulleys and wherein said log is clamped to said carriage by a hydraulically controlled dogging arrangement 44 (FIG. 9. 19).

The log transport system 14 further includes a plurality of adjustable carriage 56 guides 64 each of which is affixed on either side of said carriage 56 to the sawmill frame 24 and each of which incorporates, affixed to its inner surface, a bearing material.

The log cutting system 16 further includes a blade housing 46 consisting of a generally rectangular shaped canopy formed from rigid material of uniform wall thickness and incorporating at one opening dual safety shields 42 of flexible, resilient material of uniform thickness and affixed to the outer surface of the blade housing 46 by any conventional means such as riveting.

The separation system 18 is comprised of a plurality of chain or belt driven rollers 52 and 52' mounted via bearing blocks 60 to the sawmill frame 24 and located to the inside of the centering system support structure 31 and opposite the log feed system 10.

Dual, endless loop belts 70 supported on the frame 24 extend longitudinally from the rear of the blade housing 46 in a horizontal plane and terminate in a hydraulically controlled movable platform 74 of rigid material incorporating at one end a reticulated rigid structure 76 supporting a scissor mechanism 90 wherein said scissor mechanism 90 extends upwardly through the reticulated structure 76 when the movable platform 74 is in a horizontal position and withdraws from the reticulated structure 76 as the platform 74 is moved upwardly off the horizontal plane. A flat rectangular backboard 72 of rigid material having a uniform thickness and supported by a plurality of braces 94 is removably positioned in a horizontal plane with the platform 74.

The manner of utilizing the method of the present invention is as follows:

Power to the mill is provided by any appropriate and convenient means (the embodiment presented herein utilizes an externally mounted diesel engine-not shown). Raw logs are stacked on the log feed system 10 such that each log straddles the chain shrouds 32. The bucking fingers 100 and 100' are raised, the hydraulic cylinder 34 is activated, rotating the crank webbs 28 to a lowered position, and the chain drive 29 and 30 engaged thus releasing the log 50' into the transport system 12 where the log 50' is halted by butting against the upraised bucking fingers 100 and 100'.

The hydraulic cylinder is activated in the opposite direction rotating the crank webbs 28 into an upright position thus securing the next in line log 50 within the feed system 10. The bucking fingers 100 and 100' are lowered and the centering system 12 concurrently raised. The centering fingers 40 are rotated upwards in a swinging arc, gathering the log 50' onto the carriage 56. The chain drives 35 are engaged, thus rotating shafts 33, sprockets 54 and 54' and hence rotating the log 50' upon the carriage 56 while the centering fingers 40 complete their upward arc. The centering fingers 40 lock to either side of the log 50' centering the log 50' on the carriage 56. The dogging arrangement 44 is hydraulically activated and clamps the log 50' securely to the carriage 56. The centering fingers 40 are withdrawn and the centering system 12 lowered.

The log 50' is transported via the movable carriage 56 to the rotating blades 62 which are spaced according to the thickness of the log such that the minimum of material will be removed consistent with squaring the log 50'. As the log is passing through the blades 62, the platform 74 is moved to an upright position. When the first cut to the log 50' is complete the side cut material falls to the moving belts 70 where it is carried off the end of the mill and stopped by the backboard 72.

The carriage 56 is returned to its starting position and the blade 62 spacing closed to provide an additional minimum cut consistent with squaring the log 50'. The carriage is then moved forward into the rotating blades 62 and another cut begun. As this second cut is occuring, the platform 74 is returned to a horizontal position and the scissor mechanism 90 retracted below the level of the reticulated structure 76. When the cut is complete, the side boards fall to the moving belts 70 and are deposited upon the platform 74.

The carriage 56 is, once again, returned to its starting position, the centering system 14 is raised, the dogging arrangement 44 is withdrawn, the centering fingers 40 are raised in an upward arc, shafts 33 and hence sprockets 54 and 54' are rotated and the log 50' is turned onto one of its two sawn sides. The centering fingers 40 lock to either side of the log 50' centering the log 50'on the carriage 56. The dogging arrangement 44 is activated and the log 50' clamped to the carriage 56. The centering fingers 40 are withdrawn and the centering system 12 lowered. The spacing of the blades 62 is increased and the carriage 56 moved forward through the rotating blades. As the log 50' is being cut, the platform 74 is raised to a vertical position and the scissor mechanism 90 extends upwardly through the reticulated structure 76 thus trapping the side boards deposited on the platform 74 from the last cut. When the cut is completed, the side cuts fall to the movable belts 70 and are carried off the end of the mill where they are stopped by the backboard 72 and fall in a stack with the previously deposited side cut material.

The carriage 56 is returned to its starting position and the blade 62 spacing closed to provide an additional minimum cut consistent with squaring the log 50'. The carriage is then moved forward into the rotating blades 62 and another cut begun. As this additional cut is occuring, the platform 74 is returned to a horizontal position and the scissor mechanism 90 retracted below the level of the reticulated structure 76 depositing the side boards previously trapped by the extended scissor mechanism 90 into a stack of such boards 96. When the cut is complete, the side boards fall to the moving belts 70 and are deposited upon the platform 74.

The carriage 56 is once again returned to its starting position, the dogging arrangement 44 is withdrawn and the bucking fingers 100 and 100' are extended upward, ejecting the squared timber 92 onto the series of chain driven rollers 52 and 52' which carry the squared timber 92 to a stacking area 23 located at the opposite end of the mill from both the side board stacking area 20 and the scrap stacking area 22. The crank webbs 28 are again lowered by the action of the hydraulic cylinder 34, releasing the next in line log 50 into the mill where the process as described above is repeated.

Ramifications and Scope

From the description above, a number of advantages of the square timber production method become evident:

(a) a high production output can be readily achieved due to the high degree of automation;
(b) a relatively small number of operating personnel are required;
(c) the product is consistent, i.e., the heart wood will be centered in each timber produced; and
(d) the mill utilizes well known and well understood technology Accordingly, the reader will see that the method of producing heart centered square timber described herein offers a highly automated, efficient and cost-effective alternative to existing small sawmills.

Another feature of the present invention is that it permits of portability—thus opening the possibility for reduced stumpage fees by providing the ability to bring the mill to the harvest rather than vice-versa.

Although only a single embodiment of the present invention has been described and illustrated, the present invention is not limited to the features of this embodiment, but includes all variations and modifications within the scope of the claims. For example, reciprocating blades may be substituted for rotating blades, the carriage may be of the overhead type as opposed to that illustrated, and the various means and sequencing of separation may change without any departure from the spirit of the present invention.

I claim:

1. An improved portable saw mill of the type having a rigid frame, a horizontal rail mounted longitudinally on the rigid frame, a pair of arbors mounted on the rigid frame for rotation about parallel axes in a plane above and normal to the horizontal rail, a pair of circular saw blades each axially mounted for rotation on a respective one of the pair of arbors, means for adjusting the saw blades to selected positions spaced on opposite sides of the horizontal rail, driving means for rotating the arbors and saw blades, a carriage engaging the rail for movement therealong from a start position at one end of the rail to a stop position at the other end of the rail, the carriage dimensioned to pass between the saw blades at any selected position, dogging means to secure a log to the carriage, and means for reciprocating the carriage between the carriage start position and the carriage stop position past the saw blades, and wherein the improvement comprises:

raw log feed means comprised of a pair of elongate parallel channels spaced apart a fixed distance, the distance less than the anticipate average log length, disposed in a horizontal plane, perpendicular to and aligned with the carriage in the carriage's start position each channel incorporating a driven endless loop chain for drivingly engaging a log deposited at one end of the channels and conveying the log toward the carriage;

log centering means comprised of at least a pair of horizontally opposed and inwardly tapering rigid fingers, the fingers normally biased below the plane of the carriage and rail and to either side of the carriage and rail, hydraulic actuator means which, when activated, extend the fingers vertically upward on either side of the carriage and rail thereby centering any log mounted upon the carriage axially to the carriage and, when de-activated retract the fingers to below the plane of the carriage and rail;

means for rotating a log mounted upon the carriage comprised of at least a pair of horizontally opposed, oppositely driven sprockets, the sprockets engaging the log and rotating the log through 90° degrees about its axis;

means for removal of scrap wood and side cuts comprised of a pair of parallel, horizontally disposed conveyer belts located downstream of the saw blades with each belt axially aligned with a respective saw blade; and cant removal means comprised of a horizontally disposed conveyer means located in close parallel proximity to the horizontal rail and carriage.

2. The structure of claim 1 wherein the raw log feed means further includes a pair of hydraulically retractable blocking fingers located one at each end of the respective channels, which fingers, when raised, prevent forward movement of a log deposited upon the channels and, when retracted, permit the log to move forward onto the carriage.

3. The structure of claim 1 wherein the scrap wood and side cut removal means further includes a means for separating the scrap wood from the side cuts.

4. The structure of claim 3 wherein the means for separating scrap wood from side cuts is comprised of a vertical blocking means located a distance from the end of the conveyor belts away from the saw blades so that the forward momentum of wood exiting the conveyor belts is arrested.

5. The structure of claim 4 further including platform means horizontally aligned with the conveyer belts between the end of the conveyor belts and the vertical blocking means, the platform means pivotable along one edge parallel with the conveyor belts so that the platform means can be raised from a horizontal to a vertical position at intermittent intervals thereby directing the side cuts to a different stacking point than the scrap wood.

6. The structure of claim 1 wherein the cant removal means further includes a pair of retractable bucking fingers located below the horizontal rail and to one side of the horizontal rail so that when the bucking fingers are raised they contact one edge of the cant thereby moving the cant off the carriage and onto the horizontal conveyor means parallel with the rail.

7. A method for the production of heart centered substantially square timbers comprising the steps of:

a) feeding a raw log to the saw mill as claimed in claim 1.

b) centering the log upon the carriage in the carriage's start position;

c) adjusting the saw blade gap to approximate a dimension slightly smaller than the log diameter;

d) passing the carriage and log between the saw blades from the carriage's start position to the carriage's stop position to affect a cleaning action wherein bark and branch roots are removed;

e) retracting the carriage and log back to the carriage's start position;

f) re-adjusting the saw blade gap to a smaller size sufficient to square both sides of the log;

g) passing the carriage and log through the saw blades from the carriage's start position to the carriage's stop position;

h) retracting the carriage and log back to the carriage's start position;

i) rotating the log upon the carriage axially through 90 degrees;

j) centering the log upon the carriage; and k) repeating steps (a) to (j).

* * * * *